United States Patent [19]

Shaw

[11] Patent Number: 4,924,611

[45] Date of Patent: May 15, 1990

[54] FRAMES FOR VEHICLES LICENSE PLATES AND THE LIKE

[76] Inventor: Stuart Shaw, 9400 Jongroner Ct., Potomac, Md. 20854

[21] Appl. No.: 379,316

[22] Filed: Jul. 13, 1989

[51] Int. Cl.[5] ..... G09F 7/00

[52] U.S. Cl. ..... 40/210; 40/200; 40/209

[58] Field of Search ..... 40/210, 910, 200, 209, 40/638

[56] References Cited

U.S. PATENT DOCUMENTS

| | | | |
|---|---|---|---|
| D. 163,328 | 5/1951 | Rothman | 40/209 X |
| 1,260,156 | 3/1918 | DeForeest | 40/209 X |
| 1,816,289 | 7/1931 | Kleinsmith | 40/200 |
| 1,985,227 | 12/1934 | Bland | 40/200 |
| 2,105,679 | 1/1938 | Weindel Jr. | 40/210 X |
| 2,869,261 | 1/1959 | Audette | 40/210 X |
| 3,315,387 | 4/1967 | Heuser | 40/638 |

FOREIGN PATENT DOCUMENTS

| | | | |
|---|---|---|---|
| 599186 | 5/1960 | Canada | 40/200 |

*Primary Examiner*—Laurie K. Cranmer
*Attorney, Agent, or Firm*—John C. Smith, Jr.

[57] ABSTRACT

A frame comprising upper, lower, and side bars outlines a space to display a license plate. At least one of the bars, preferably the lower, has a depressed track in which a number of message elements or strip is carried which bear message indicia on its front surface. The track has upper and lower lips depending from and extending up from respectively the upper and lower margins of the track. A resilient, transparent cover slipped between the lips holds the message elements in place against the track back and with the indicia exposed to view. The lips may be frangmented into one or more sections, and only one lip may serve. The number of message elements may be reduced to a single, integral strip.

18 Claims, 1 Drawing Sheet

FIG. 1
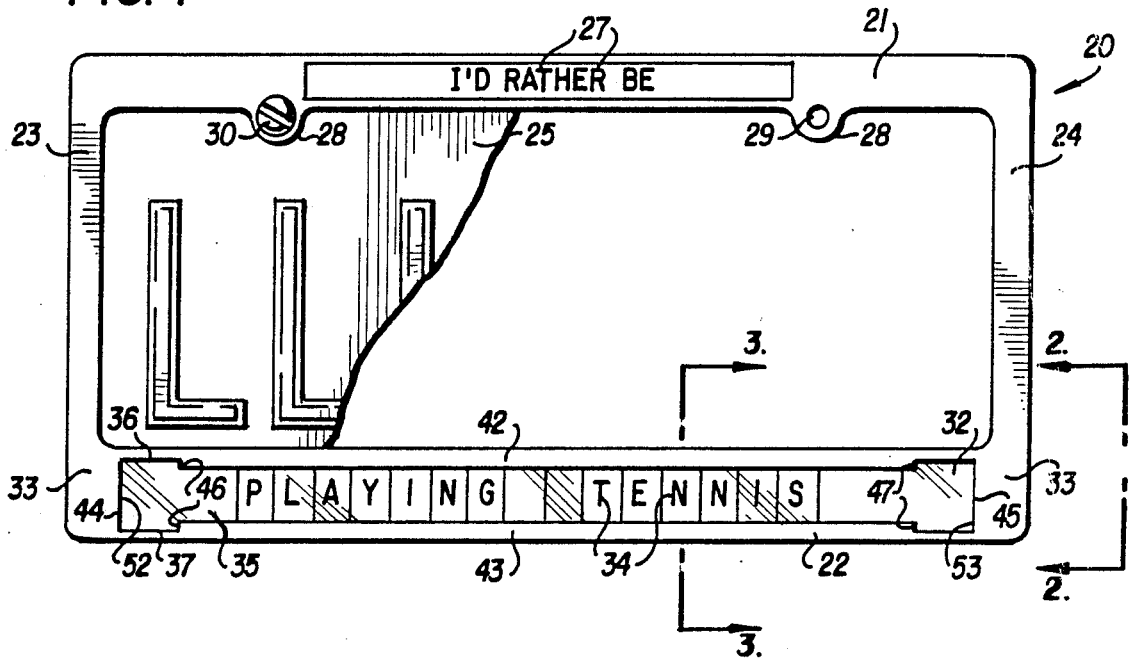
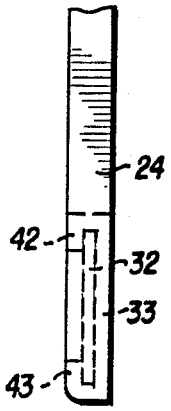
FIG. 2
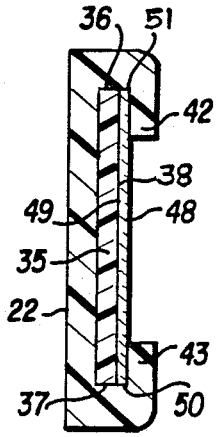
FIG. 3
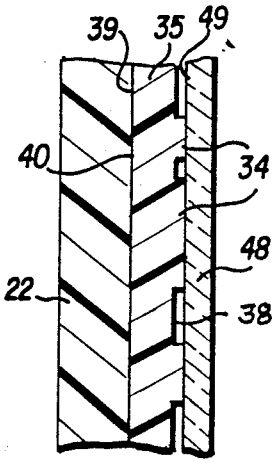
FIG. 4
FIG. 5
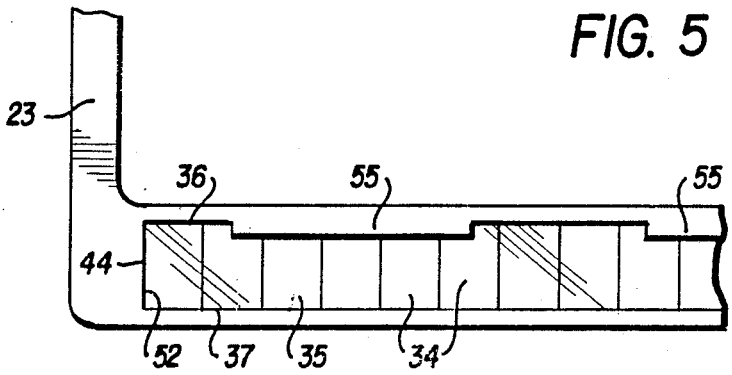

FRAMES FOR VEHICLES LICENSE PLATES AND THE LIKE

FIELD OF THE INVENTION

The invention relates to frames for vehicle license plates and the like.

BACKGROUND OF THE INVENTION

Vehicles carrying license plates sometimes have a frame which carries a message and outlines the plate, thereby calling attention to the message. For example, U.S. Pat. No. 2,869,261 to Audette Jan. 20, 1959, for Frames for Vehicle License Plates or the Like describes such a license plate frame.

As described in the Audette patent, one of the frame bars, the top bar, provides grooves at top and bottom 20, which extend parallel to each other. Letters are provided with gripping fingers which frictionally engage the parallel grooves. Thus the letters may spell out a message as desired by the user. Color contrast may be employed to enhance the contrast of letters against the frame.

SUMMARY OF THE INVENTION

According to the present invention upper, lower, and side bars integrally connected form the frame outlining a display space to display the license. A recessed track on one or more of the bars is planar at the back and has upper and lower longitudinal margins and side margins. A number of message elements or message strip has a planar back and front, closely fit into the track upper and lower margins. A substantially planar and transparent resilient cover has planar front and back surfaces. The cover is fastened to the frame with the cover back surface in close contact with and flush against the front surface of the message elements or strip.

In a preferred embodiment lips extend down and up respectively from the upper and lower track margins, spaced from the ends of the recessed track. The cover is resilient and may be slid into place under the lips. The message elements or strip and the cover are retained in place by the margins of the recessed track and the lips. The lips thus serve to provide entry to the resilient cover and also retain it in place. The message elements or strip may be a single integral strip and the message indicated by indicia which may be applied to the front surface of the integral message element by paint or by pre-printed indicia on the element or strip, or by applying to the element pressure sensitive adhesive indicia bearing the desired message. The message element may also be individual, separate elements with pre-printed indicia on the front of each element.

Other embodiments of the present invention employ the recessed track and the defining margins without the lower lip, or without the upper lip, or employ one or both lips segmented.

DESCRIPTION OF THE DRAWING

The various objects, advantages, and novel features of the invention will be more fully apparent from a reading of the following detailed description when read in connection with the accompanying drawing, in which like reference numerals refer to like parts and in which:

FIG. 1 is a face view of a preferred embodiment of the invention;

FIG. 2 is a partial side view along the lines 2—2 of FIG. 1;

FIG. 3 is a sectional view along the lines 3—3 of FIG. 1;

FIG. 4 is an enlarged, partial sectional view along the lines 3—3, of FIG. 1; showing only an intermediate part between the top and bottom of FIG. 3; and FIG. 5 is a partial face view of another embodiment of the invention.

DETAILED DESCRIPTION

Referring to FIGS. 1-4, which illustrate a preferred embodiment of the invention, a license plate frame 20 comprises upper and lower longitudinal bars 21, 22 respectively and left and right side bars 23 and 24 respectively. The bars 21, 22, 23, and 24 together form a substantially rectangular integral body outlining a central vacant rectangular display space for display of the license plate 24. The upper longitudinal bar 21 has a legend on it, which may be formed of raised indicia, in this case of raised letters 27, which proclaim "I'D RATHER BE". These letters are formed on the plastic bar itself. The upper bar 21 also carries a pair of ears 28 which have apertures 29 suitable to receive screws 30 (only one of which is shown) for attaching the license plate 25, partially shown in FIG. 1, to the vehicle. The lower bar 22 has a longitudinal track 32 recessed in depth and spaced longitudinally inward from the longitudinal ends 33 of the lower bar 22. The upper bar 21 may also have a longitudinal recessed track (not shown), similar to the longitudinal, recessed track 32 of the lower bar 22, to perform the same function as the track 32 on the lower bar which is described and explained below.

Message indicia 34 are carried by a number of message elements or message strip 35 in the track 32. A message strip 35 as shown in FIG. 1 fits closely within the upper and lower margins 36 and 37 of track 32. The message elements or message strip 35 has a planar front 38 and a planar back 39 extending in the longitudinal and transverse directions. The planar back 39 is flush, that is, in surface contact against the planar front 40 of the track 32. Upper and lower longitudinally extending lips 42 and 43 respectively depend down from and extend up from the upper and lower track margins 36, 37. The left and right longitudinal ends 44 and 45 respectively of the recessed track 32 are longitudinally beyond the left and right ends 46 and 47 respectively of the upper and lower lips 42 and 43.

A relatively flat, resilient, substantially planar and transparent longitudinal cover 48 has a planar back 49 extending longitudinally and transversely and has a planar front extending longitudinally and transversely. The back 49 fits against the front planar surface 38 of message elements or message strip 35. The top edge 51 of the cover 48 fits against the upper track margin 36, and the lower edge 50 of the cover 48 fits against the lower track margin 37 and is thus retained in place transversely, or vertically as shown. The left and right ends 52 and 53 of the cover 48 respectively fit just within the left and right track margins 44 and 45. Thus the cover 48 fits within the track margins and is secure against longitudinal or transverse motion with respect to the track.

The license plate frame 20 may be made of any suitable material, preferably light plastic, and the message elements or message strip 35 also may be made of plastic. The message elements or message strip 35 bear suitable indicia 34 to carry the desired message. The indicia 34 may be printed or painted on the front surfaces, or pressure sensitive adhesive indicia 34 may be applied to the front surfaces to carry the message. The indicia 34 being thin do not affect substantially the planar nature of the front surfaces of the message elements or message strip 35, which allows the cover to be slipped into place. The showing of depth of the indicia 34 in FIG. 4 is greatly exaggerated; the depth is so small that it does not functionally affect the arrangement. After the message elements or message strip 35 are arranged in place to carry indicia 34 with a desired message, such as "PLAYING TENNIS" as shown, or any other, with space indicia blank or omitted as desired, the cover 48 may be applied. Message elements or a message strip 35 with pre-applied indicia 34, as described, may be used. If the number of message elements or message strip 35 is one, a single unitary, integral strip 35 may be employed, as shown in FIG. 1, and be resilient or flexible to slip under the lip or lips 42, 43.

To apply the cover 48, the cover may be slid from left to right, as viewed in FIG. 1, for example, with the right end of the cover introduced from the left under the lips 42, 43 and over the message elements or message strip 35 bearing the indicia 34. To improve the sliding, the leading edge of the cover 48 may be chamfered, rounded, or bevelled (not shown). As the cover 48 is slid to the right, the cover near its left end must be bent up to remain under the left ends 44 of the track margins and yet ride over the face of the strip and the message elements or message strip 35. When the right end 53 of the cover 48 reaches the right end margin 45 of the recessed track or channel 32, the left end of the cover 48 may he released and the cover 48 will then snap into the track 32. Both the left and right ends 52 and 53 of the cover 48 will be held in place longitudinally by the track left and right margins 44 and 45.

If desired one may use a single lip, provided the cover 48 is closely dimensioned to the dimensions of the track 32 longitudinally and transversely and the depth dimensions of the cover 48 are such that the cover closely confines the back 39 of the message elements or message strip 35 against the front 40 of the track 32. If the cover 48 is invariably to be slipped in from the left, the right ends 47 of the lips 42, 43 may be coterminous with the right end 45 of the track. The ends of the cover 48 are in alignment respectively with the left and right margins 44 and 45 of the recessed or depressed track 32. When the top edge 51 of the cover 48 strikes the opposite, upper track margin 36 under the single lip, the cover 48 may be released, and the cover will snap in place and be retained against the message elements or message strip 35. Side slippage will be prevented by the track side or end margins 44, 45 and transverse slippage by the upper and lower track margins 36, 37 which will prevent movement up or down relative to the track by the cover 48, as previously described.

As noted, the cover 48 holds the assembly intact with respect to the frame 20 with the message elements or message strip 35 with back planar surface 39 flush against the front planar surface 40 of the track, and with the front surface 38 of the message elements or message strip 35 retained flush against the back planar surface 49 of the cover 48.

The cover 48 may be cleaned readily to retain legibility of the message elements or message strip 35. The message may readily be selected as desired, for example, by using pressure sensitive adhesive message indicia 34 on the front surface 38, or replacing such indicia, or by using a set of message elements or message strip 35 with pre-printed indicia 34 (by which is meant to include painting or other such applications of indicia) and selecting the desired ones to make up the desired message, or by using a pre-printed strip containing message indicia 34 permanently in place. If a pre-printed strip is used the strip would slide into the track in a similar way as the cover 48, but before the cover is installed so that the strip is under the cover. The message may of course be changed by managing removal of the cover by steps the reverse of its placement, which would involve prying up a free corner or edge of the cover 48, withdrawing the cover 48, and then changing the message elements or message strip 35 and indicia 34, or changing the indicia 34 borne by the message elements or message strip 35, and replacing the cover 48. Frames according to the invention are simple, easy to use, and afford versatility. The message elements or message strip and the indicia as described are covered and unexposed, so that they do not offer as easy an opportunity for catching or being struck individually or in a group by some outside agency as in the case of the prior patent mentioned; nor can anyone readily tamper with them.

Preferably the cover is inserted as described; yet if the cover has sufficient flexibility and resilience, and only a single lip is present rather than an upper and a lower lip, the cover may also be inserted by slipping it under a single lip.

For example, if only one of the lips 42, 43 are present, the cover 48 may be slipped over the message elements or message strip 35 and under the remaining lip either from above or below as the case may be, as will be clear from the embodiment of FIG. 5.

Consider, for example, the embodiment as viewed in the face view of FIG. 5. In this case the upper lip is not continuous, but is fragmented longitudinally into segments 55. Therefore in this view the upper track margin 36 is exposed in the areas where the segments 55 are absent. The lower lip 43 is completely absent. Instead of the number of message elements or message strip being one which is a single unitary integral strip 35 as in FIG. 1, the message elements 35 in FIG. 5 are several, the strip being partitioned into a plurality of sections. Otherwise the embodiment of FIG. 5 is similar to that of FIG. 1.

The way in which the plurality of message elements in FIG. 5 are applied and in which the resilient cover 48 is entered over them will be apparent from what has been said heretofore. The cover may be applied in a manner similar to that described for FIG. 1.

For example the resilient cover 48 in the embodiment of FIG. 5 may be entered under the fragmented lip segments 55 from below or from the side. Due to the resilience of the cover 48 and the cover 48 being sized to fit closely within the margins top and bottom and sides of the track 32 may then be allowed to snap into position. The cover 48 then cannot readily be slipped in any direction, being retained by the margins and held against the planar fronts of the message elements 35 by the segments 55 of the upper lip.

The use of such terms as upper, lower, and the like are intended to be descriptive of the structure as it may be oriented in use, and is not intended to be restrictive in the claims to that orientation.

Accordingly the present invention affords a way of providing a message on the license plate frame that is readily contrived according to individual taste, changed without difficulty, held in place with some security, not easily tampered with (as is the case when the message elements are exposed as in the prior art patent cited above), the letters or indicia not as readily removable by accidentally catching on some external object, as in the prior art patent cited above, and the cover may be easily cleaned or inexpensively replaced so that the indicia may be easily read if the cover becomes soiled.

I claim:

1. A license plate frame for displaying a license plate and a message on a vehicle comprising:

upper and lower longitudinal bars and transverse side bars, the bars being integrally connected together to form a substantially rectangular integral body having longitudinal, transverse, and depth dimensions in respectively mutually normal longitudinal, transverse, and depth directions, the body outlining a central vacant rectangular display space for display of the license plate, at least one longitudinal body bar having a longitudinal front-facing track recessed in depth from front to rear, the track having a back planar in the longitudinal and transverse directions, the track having parallel upper and lower longitudinal margins and parallel side margins defining the longitudinal and transverse extent of the recessed track, the frame having means for attachment to the vehicle with the plate exposed to view through the display space;

a number of indicia;

a number of message elements each fitting closely within the upper and lower track margins, the number of message elements each having planar front and back surfaces separated in depth and extending parallel to each other in the longitudinal and transverse directions, the number of message elements bearing indicia on the front message element surfaces and applied against the back of the track with the planar message element back surfaces in surface contact flush against the back of the track;

the frame including means for holding the number of elements against the back of the track comprising a substantially planar and transparent resilient cover having front and back planar surfaces extending parallel to each other in the longitudinal and transverse directions with the back planar surface of the resilient cover in contact with and flush against the front surface of the number of message elements and indicia, the number of message elements and indicia being changeable by virtue of the resilience of the cover affording withdrawal and replacement of cover, message elements and indicia;

whereby the cover holds the message elements in position in the track, whereby the margins prevent side and vertical motion of the elements relative to the track, and whereby indicia on the front surface of the message elements may be read through the transparent cover.

2. A license plate frame as claimed in claim 1, the number of message elements being one and the element being a single integral element in the form of a strip.

3. A license plate frame as claimed in claim 1, the number of elements being a plurality partitioned into sections.

4. A license plate frame as claimed in claim 1, further comprising:

one of upper and lower lips respectively depending transversely down from and extending transversely up from the upper and lower margins respectively, the means for holding the number of elements and the cover in place including the one lip, the track, any lip, and the number of message elements being relatively dimensioned to permit the cover to be slid into place under any lip and over the number of message elements and indicia in the track.

5. A license plate frame as claimed in claim 4, the one lip being the upper lip.

6. A license plate frame as claimed in claim 4, the one lip being a lower lip.

7. A license plate frame as claimed in claim 4, comprising also the other lip, the means for holding the cover in place over the number of message elements comprising both lips.

8. A license plate frame as claimed in claim 4, the message indicia comprising pressure sensitive adhesive indicia applied by their adhesion to the front surfaces of the number of message elements.

9. A license plate frame as claimed in claim 4, the message indicia being pre-printed on the front surface of the number of message elements.

10. A license plate frame as claimed in claim 4, the attachment means comprising a pair of apertures in one of the bars.

11. A license plate frame as claimed in claim 4, the cover being slipped transversely under and held in place by the one lip.

12. A license plate frame as claimed in claim 11, the one lip being the lip depending from the upper margin.

13. A license plate frame as claimed in claim 11, the one lip being the lip extending up from the lower margin.

14. A license plate frame as claimed in claim 4, the one lip being segmented.

15. A license plate frame for displaying a license plate and a message on a vehicle comprising:

upper and lower longitudinal bars and transverse side bars, the bars being integrally connected together to form a substantially rectangular integral body having longitudinal, transverse, and depth dimensions in respectively mutually normal longitudinal, transverse, and depth directions, the body outlining a central vacant rectangular display space for display of the license plate, at least one longitudinal body bar having a longitudinal front-facing track recessed in depth from front to rear, the track having a back planar in the longitudinal and transverse directions, the track having parallel upper and lower longitudinal margins and side margins defining the longitudinal and transverse extent of the recessed track, the frame having means for attachment to the vehicle with the plate exposed to view through the display space;

a number of indicia;

a number of message elements each fitting closely within the upper and lower track margins, the number of message elements each having planar front and back surfaces separated in depth and extending parallel to each other in the longitudinal and transverse directions;

the number of message elements bearing indicia on the front message element surfaces and the elements applied against the back of the track with the planar message element back surfaces in surface contact flush against the back of the track;

a substantially planar and resilient cover having front and back planar surfaces extending parallel to each other in the longitudinal and transverse directions, means for holding the number of elements against the back of the track with the back planar surface of the cover in contact with and flush against the front surface of the number of message elements and indicia, the holding means including the cover over the message elements and one of upper and lower lips respectively depending transversely down from and extending transversely up from the upper and lower margins respectively, the recessed track having one longitudinal end extending longitudinally beyond the one lip, the resilient cover being longitudinally substantially coextensive with the recessed track, whereby the resilient cover may be slid longitudinally into the track under the one lip from the one end and then entered completely into the track.

16. A license plate frame as claimed in claim 15, the recessed track having the other longitudinal end extending longitudinally beyond the lip, whereby the resilient cover may be slid into the track from under either longitudinal end of the lips.

17. A license plate frame for displaying a license plate and a message on a vehicle comprising:

upper and lower longitudinal bars and transverse side bars, the bars being integrally connected together to form a substantially rectangular integral body having longitudinal, transverse, and depth dimensions in respectively mutually normal longitudinal, transverse, and depth directions, the body outlining a central vacant rectangular display space for display of the license plate, at least one longitudinal body bar having a longitudinal front-facing track recessed in depth from front to rear, the track having a back planar in the longitudinal and transverse directions, the track having parallel upper and lower longitudinal margins and side margins defining the longitudinal and transverse extent of the recessed track, the frame having means for attachment to the vehicle with the plate exposed to view through the display space;

a number of indicia;

a number of message elements each fitting closely within the upper and lower track margins, the number of message elements each having planar front and back surfaces separated in depth and extending parallel to each other in the longitudinal and transverse directions;

the number of message elements bearing indicia on the front message element surfaces and the elements applied against the back of the track with the planar message element back surfaces in surface contact flush against the back of the track;

a substantially planar and resilient cover having front and back planar surfaces extending parallel to each other in the longitudinal and transverse directions, the frame including means for holding the number of elements against the back of the track with the back planar surface of the cover in contact with and flush against the front surface of the number of message elements and indicia, the holding means comprising the cover and upper and lower lips respectively depending transversely down from and extending transversely up from the upper and lower margins respectively, the means for holding the number of elements and the cover in place including both lips, both lips having a lesser longitudinal extent at one end than the longitudinal extent of the recessed track at the same end, so that the cover may be slipped in place from that one end.

18. A license plate frame as claimed in claim 17, both lips having a lesser longitudinal extent at the other end so that the cover may be slipped in place from either end.

* * * * *